United States Patent [19]

Morano et al.

[11] Patent Number: 4,759,099

[45] Date of Patent: Jul. 26, 1988

[54] DOOR CLOSURE AND HOLDING MECHANISM HAVING A SLIDING ROD SLIDABLY MOUNTED TO A PIVOTING ROD AND A SLIDE RAIL

[76] Inventors: Francois Morano, Villa Tjandi Avenue Joachim, 06100 Nice; Victor Mouriesse, Domaine de Fontbelle, 83870 Besse sur Issole, both of France

[21] Appl. No.: 63,733

[22] Filed: Jun. 17, 1987

Related U.S. Application Data

[63] Continuation of Ser. No. 771,003, Aug. 30, 1985, abandoned.

[30] Foreign Application Priority Data

Sep. 14, 1984 [FR] France ..... 84 14318

[51] Int. Cl.[4] ..... E05F 3/22

[52] U.S. Cl. ..... 16/64; 16/49; 16/DIG. 17

[58] Field of Search ..... 16/49, 62, 64, 65, 69, 16/70, 78, 79, 80, 85, 51, DIG. 9, DIG. 10, DIG. 17

[56] References Cited

U.S. PATENT DOCUMENTS

| | | | |
|---|---|---|---|
| 786,498 | 4/1905 | Jeton | 16/80 |
| 2,056,876 | 10/1936 | Williams | 16/65 |
| 2,352,016 | 6/1944 | Sasgen | 16/85 |

FOREIGN PATENT DOCUMENTS

| | | |
|---|---|---|
| 2540545 | 8/1984 | France . |
| 0086346 | 9/1920 | Switzerland . |

*Primary Examiner*—Fred Silverberg
*Attorney, Agent, or Firm*—Sandler & Greenblum

[57] ABSTRACT

This invention relates to a device ensuring automatic closure of pivoting doors and for holding them in open position. The device includes a fixed box mounted on the door (or frame) and supporting a pivoting arm subjected to the action of a return element. A fixed slide rail is mounted on the frame and a connecting element is positioned between the pivoting arm and the slide rail. The connection between the pivoting arm and the slide rail is obtained by way of a sliding rod, retractable inside the arm. The rod is adapted to be blocked automatically when it projects from the arm by a determined length corresponding to a given degree of opening of the door.

8 Claims, 3 Drawing Sheets

DOOR CLOSURE AND HOLDING MECHANISM HAVING A SLIDING ROD SLIDABLY MOUNTED TO A PIVOTING ROD AND A SLIDE RAIL

This application is a continuation of application Ser. No. 771,003, filed Aug. 30, 1985, and now abandoned.

BACKGROUND OF THE INVENTION

1. Field of the Invention

The present invention relates to an improved device for ensuring automatic closure of pivoting doors and for holding them in open position.

In the following specification, the invention will be described for a device for ensuring automatic closure of a door which is opened manually, but it is obvious that this is not limiting and that such a device may possibly be motorized in order also to ensure automatic opening.

2. Prior Art

The most wide-spread device for ensuring automatic closure of a pivoting door is essentially constituted by a system of compasses with two legs, one being mounted to pivot on a box fixed on the door (or frame), the hinge pin being subjected to the action of a return means (spring system) and the end of the other leg being fixed, likewise in pivoting manner, on the frame (or door). Although such a device ensures automatic closure of the door, it nonetheless presents a certain number of drawbacks. In fact, taking into account their design, the compasses work over 90°, which brings about the creation of a considerable torque which, in the end, provokes wear of the hinge pins and even tear of the fixations. Moreover, it creates hard points during opening and, in general, it does not allow the door to be blocked in open position, which blocking must generally be effected via an additional element actuated by the foot, for example.

Various solutions have been proposed in order to overcome these drawbacks. For example, mention may be made of the solution proposed by French Patent Application published under No. 2 540 545 which relates to a device for automatically controlling opening of pivoting doors.

Such a device comprises:

a pivoting mechanism proper;

an arm adapted to be fixed by one of the ends to the rotating mechanism so that it may pivot in a plane;

a slide block mounted to pivot at the other end of the arm; and a guide mechanism adapted to be fixed to the door and to the frame supporting said door in order to guide the slide block in a direction parallel to the plane.

Apart from the fact that this solution is complex and expensive to carry out, it also presents the drawback of not being able to block the door in open position. It presents further drawbacks such as the impossibility to operate it manually, a considerable torque due to the presence of compasses and a high resistance to opening.

SUMMARY OF THE INVENTION

An improved device has now been found, and this is the subject matter of the present invention, which overcomes the drawbacks of the prior known solutions, the device not only blocking the door in open position, but also creating virtually no resistance to opening and eliminating virtually all risks of tear of the fixations and wear of the hinge pins. Moreover, the device according to the invention presents very small dimensions and may be adapted to any type of door.

The invention therefore generally relates to a device ensuring automatic closure of pivoting doors. The device comprises:

a fixed box mounted on the door (or frame) and supporting a pivoting arm subjected to the action of a return element;

a fixed slide rail mounted on the frame (or door);

a connecting element between the pivoting arm and the slide rail, and it is characterized in that the connection between the pivoting arm and the slide rail is obtained by means of a sliding rod, retractable inside the arm, the rod being adapted to be blocked automatically when it projects from the arm by a determined length corresponding to a given degree of opening of the door.

Such a device thus comprises two degrees of freedom in its operation.

According to a preferred embodiment of the invention, return of the pivoting arm ensuring automatic closure of the door is obtained via a rack system controlled by a spring compressed (or stretched) during pivoting of the door.

BRIEF DESCRIPTION OF THE DRAWINGS

The invention will be more readily understood on reading the following description with reference to the accompanying drawings, in which.

Figure 1:
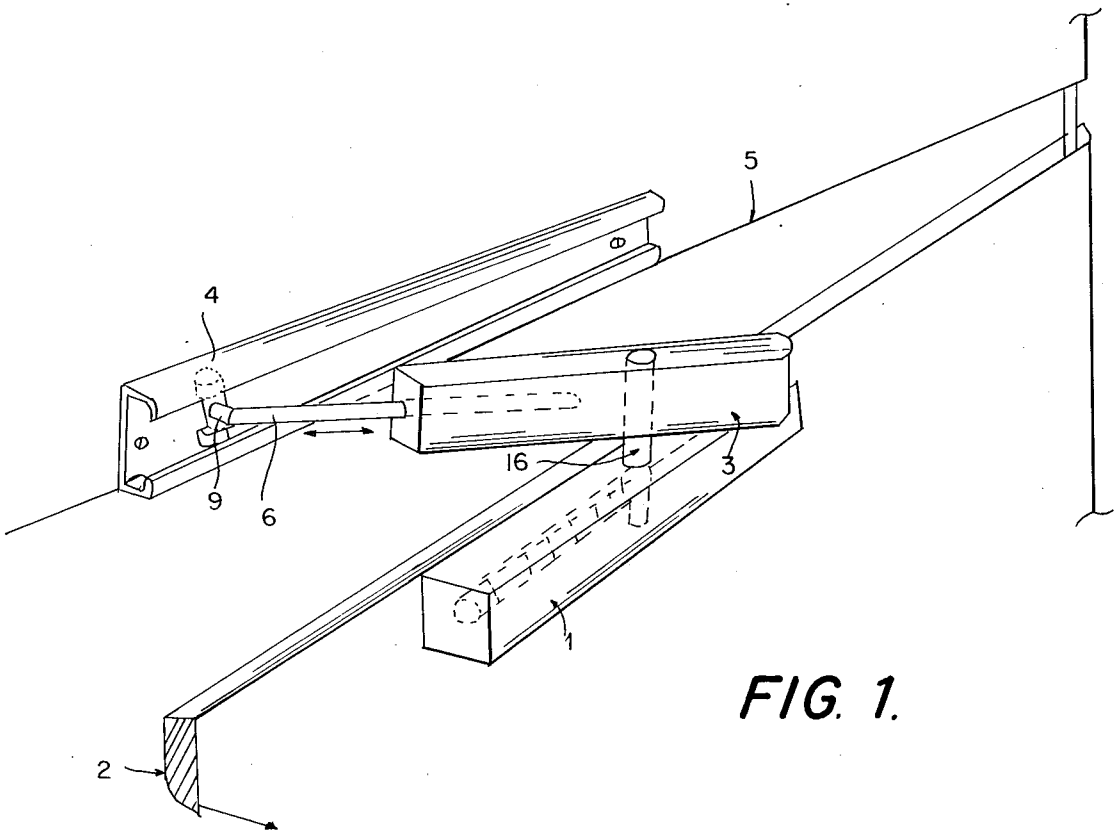
FIG. 1 is a schematic view in perspective showing the structure and operation of a device according to the invention.

Referring now to the drawings, the device according to the invention is essentially constituted by a fixed box 1 mounted on the door 2, in its upper part. This box 1 supports a pivoting arm 3, subjected to the action of a return element and which, when the door is closed, is normally maintained in superposed position with the box 1. A slide rail 4 is fixed on the frame 5 of the door.

Figure 3:
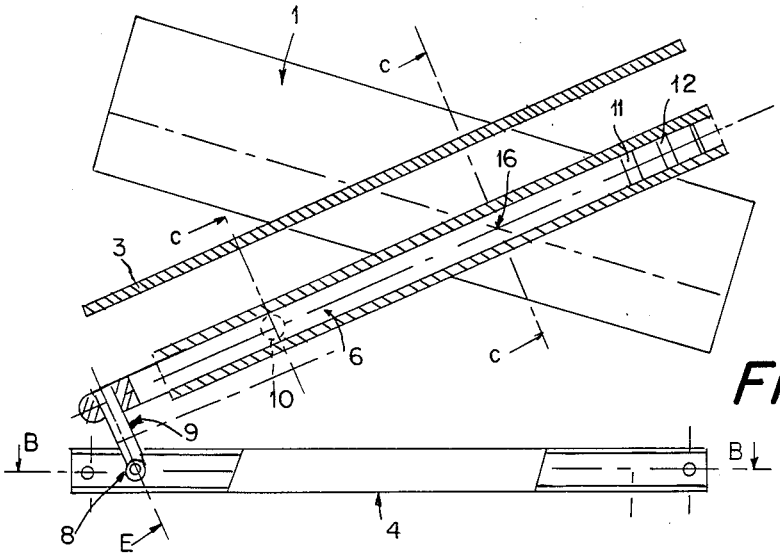
FIGS. 3 to 8 are views in detail showing more particularly the manner in which the pivoting arm, the slide rail, and the retractable rod connecting the pivoting arm to the slide rail are made.
Figure 4:
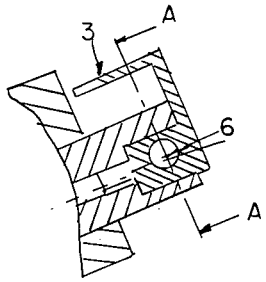
Figure 5:
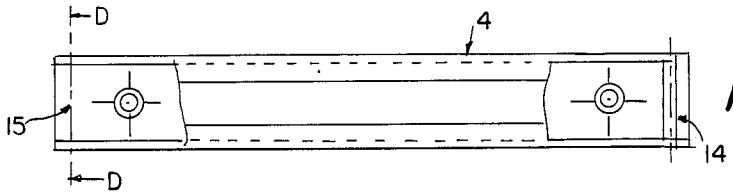
Figure 6:
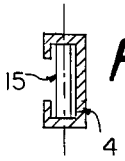

In accordance with the invention, the connection between the slide rail 4 and the pivoting arm 3 is obtained via a sliding rod 6 retractable inside the arm 3. It should be noted that the arm 3 is designed so that, when the door is closed, it may fit on the periphery of the slide rail 4. As shown more particularly in FIGS. 3 and 4, the rod 6 is mounted in the slide rail 4 by means of rollers 7, 8 mounted at the end of a return 9 provided at the end of the rod 6. Such an assembly therefore allows the angular pivoting of the rod 6 with respect to the slide rail 4.

Figure 7:
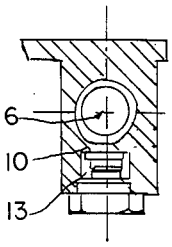
Figure 8:
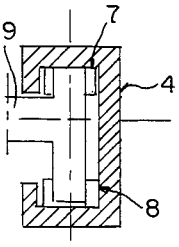

In order to hold the door in open position, the rod 6 and the pivoting arm 3 comprise means for automatically blocking the rod 6 in position. These means are, in the present case, constituted (cf. FIGS. 3 and 7) by a system of balls 10 adapted to fit in grooves 11, 12 provided in rod 6. These balls 10 are subjected to the action of a spring 13 which tends to maintain them applied against the periphery of the rod 6. When the door is open, these balls ensure immobilization, being fitted in one or the other of the grooves 11, 12, unblocking being easily effected simply by an additional push on the door.

Furthermore, the slide rail 4 comprises stops at each of its ends. These stops may be constituted by simple screws.

Figure 2:
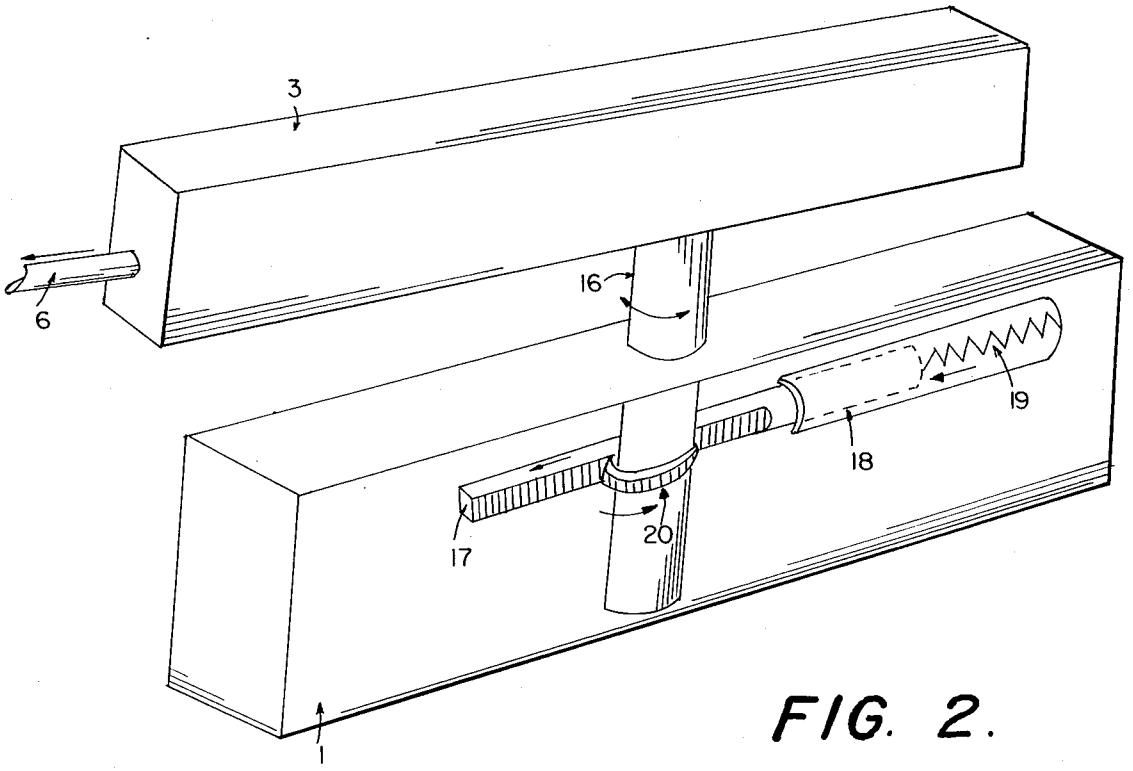
FIG. 2 is a view in detail, likewise in perspective, showing more particularly the manner in which the pivoting arm may be returned.

The return of the pivoting arm 3 and consequently the automatic closure of the door is controlled in the following manner. The arm 3 is mounted to pivot on the frame 1 via a pin 16. Inside the box 1 is disposed an assembly acting on the pin 16 and which makes it possible to maintain arm 3 and box 1 normally superposed one on the other. In this embodiment, as shown in FIG. 2, the assembly allowing return of the arm 3 is constituted by a rack 17 mounted to slide in a fixed body 18 and subjected to the action of a spring 19. This rack 17 comes into mesh with a pinion 20 mounted on the pin 16. The spring 19 normally tends to maintain the rack 17 in repelled position and consequently to return the arm 3 superposed on body 1 and to maintain the door in closed position.

Upon opening, rotation of the pin 16 provokes displacement of rack 17 and consequently compression of spring 19. As a result, when the door is released, spring 18 automatically repels rack 17, provokes rotation of pin 16 and return of arm 3.

Such a device, of particularly simple design, easy to assemble and to install, requires a very low torque for operation and consequently eliminates virtually all risk of tear in the long run.

Moreover, during opening, there are no hard points and closure is effected gently and without jerks. Of course, assembly of such a device may be reversed, i.e. the body 1 may be fixed on the frame, the slide rail 4 in that case being fixed to the upper part of door 2. Furthermore, such a device may easily be adapted to ensure not only automatic closure of the door, but also opening thereof. It may for example be envisaged to associate with the rack system for controlling rotation of the hinge pin of the arm an electric motor controlling gears and actuated automatically.

What is claimed is:

1. An apparatus for ensuring automatic closure of a door adapted to pivot within a frame and for holding a door in an open position comprising:

(a) a housing for a return assembly mounted in a fixed position on said door;

(b) a slide rail mounted in a fixed position on said frame;

(c) a pivoting arm journaled on said housing, a means for connecting said pivoting arm and said slide rail, said pivoting arm being provided with means for receiving the means for connecting said pivoting arm and said slide rail;

(d) said means for connecting comprising a sliding rod having one end retractably mounted inside said means for receiving of said pivoting arm and another end movably fitted to said fixed slide rail;

(e) a return assembly cooperatively associated with said housing; and (f) means for automatically blocking movement of said sliding rod associated with said pivoting arm when said sliding rod projects from said pivoting arm by a predetermined length corresponding to a given degree of opening of said door.

2. The apparatus according to claim 1 wherein said return assembly includes a rack having an elongate portion provided with teeth and an end biased by a spring and wherein said housing includes a chamber for receiving said rack, said return assembly further including a spring inserted in said chamber having an end wall which is compressed by said end of said rack against said end wall of said chamber and stretched during pivoting of said door.

3. The apparatus according to claim 2 wherein said pivoting arm is journalled on a pivot rod and wherein said return assembly comprises:

a pinion mounted on said p ivot rod wherein said teeth of said rack mesh with said pinion and said rack is mounted to slide within said chamber in response to said spring.

4. The apparatus according to any one of claims 1 or 2 wherein said sliding rod is provided with grooves and said means for automatically blocking movement of said sliding rod comprises:

(a), a system of balls adapted to fit in said grooves provided in said sliding rod; and (b) a series of springs associated with said balls for maintaining said system of balls against a periphery of said sliding rod.

5. An apparatus for ensuring automatic closure of a door adapted to pivot within a frame and for holding said doors in an open position comprising:

(a) a housing for a return element mounted in a fixed position on said frame;

(b) a slide rail mounted in a fixed position on said door;

(c) a pivoting arm journalled in said housing, a means for connecting said pivoting arm and said slide rail, said pivoting arm being provided with means for receiving the means for connecting said pivoting arm and said slide rail;

(d) said means for connecting comprising a sliding rod having one end retractably mounted inside said means for receiving of said pivoting arm and another end movably fitted to said fixed slide rail; and (e) a return assembly cooperatively associated with said housing;

(f) means for automatically blocking movement of said sliding rod associated with said pivoting arm when said sliding rod projects from said pivoting arm by a predetermined length corresponding to a given degree of opening of said door.

6. The apparatus according to claim 5 wherein said return assembly includes a rack having an elongate portion provided with teeth and an end biased by a spring and wherein said housing includes a chamber for receiving said rack, said return assembly further including a spring inserted in said chamber having an end wall which is compressed by said end of said rack against said end wall of said chamber and stretched during pivoting of said door.

7. The apparatus according to claim 6 wherein said pivoting arm is journalled on a pivot rod and, wherein said return assembly comprises:

a pinion mounted on said pivot rod wherein said teeth of said rack mesh with said pinion and said rack is mounted so as to slide within said chamber in response to said spring.

8. The apparatus according to any one of claims 5 or 6 and wherein said sliding rod is provided with grooves and said means for automatically blocking movement of said sliding rod comprises:

(a) a system of balls adapted to fit in said grooves provided in said sliding rod; and (b) a series of springs associated with said balls for maintaining said system of balls against a periphery of said sliding rod.

* * * * *

UNITED STATES PATENT AND TRADEMARK OFFICE

CERTIFICATE OF CORRECTION

PATENT NO. : 4,759,099

DATED : July 26, 1988

INVENTOR(S) : F. MORANO et al.

It is certified that error appears in the above-identified patent and that said Letters Patent is hereby corrected as shown below:

At column 3, line 52, i.e., at claim 1, line 13, after (d) insert ---a means for connecting said pivoting arm and said slide rail,---.

At column 4, line 7, i.e., at claim 3, line 4, change "p ivot" to ---pivot---.

At column 4, line 15, i.e., at claim 4, line 5, delete the comma after "(a)".

At column 4, lines 27-28, i.e., at claim 5, lines 8/9, delete "a means for connecting said pivoting arm and said slide rail,".

At column 4, line 32, i.e., at claim 5, line 13, after (d) insert ---a means for connecting said pivoting arm and said slide rail,---.

Signed and Sealed this

Eighteenth Day of May, 1993

*Attest:*

Michael K. Kirk

MICHAEL K. KIRK

*Attesting Officer*

*Acting Commissioner of Patents and Trademarks*